United States Patent [19]

Tarlow

[11] 4,378,641

[45] Apr. 5, 1983

[54] BOAT SHOE

[76] Inventor: Arthur S. Tarlow, 7 Cove Cir., Marion, Mass. 02738

[21] Appl. No.: 231,967

[22] Filed: Feb. 6, 1981

[51] Int. Cl.[3] ..... A43B 13/04; A43B 13/26; A43C 15/00

[52] U.S. Cl. ..... 36/32 R; 36/59 C; 36/114

[58] Field of Search ..... 36/32 R, 59 R, 59 C, 36/114; D2/319–321

[56] References Cited

U.S. PATENT DOCUMENTS

| | | | |
|---|---|---|---|
| D. 242,091 | 11/1976 | Tornero | D2/320 |
| 1,725,519 | 8/1929 | Hopwood | 36/32 R |
| 3,237,322 | 3/1966 | Santore | 36/59 C |
| 4,281,467 | 8/1981 | Anderie | 36/32 R |

FOREIGN PATENT DOCUMENTS

| | | | |
|---|---|---|---|
| 697109 | 10/1940 | Fed. Rep. of Germany | 36/59 C |
| 413699 | 6/1910 | France | 36/59 C |
| 825941 | 12/1937 | France | 36/59 C |
| 14662 | of 1884 | United Kingdom | 36/32 R |
| 513375 | 10/1939 | United Kingdom | 36/59 C |

*Primary Examiner*—James Kee Chi

*Attorney, Agent, or Firm*—Robert T. Gammons

[57] ABSTRACT

A boat shoe and sole therefor wherein there are first and second ribs protruding perpendicularly from the bottom comprising a wiping edge and inwardly thereof a plurality of uniformly-distributed, friction-engendering nubs on the surface portions of the bottom side at the forepart and heel end bounded by the aforesaid ribs and groove.

18 Claims, 7 Drawing Figures

BOAT SHOE

BACKGROUND OF INVENTION

To provide the tread surface of a shoe bottom with friction engendering means in the form of nubs or ribs distributed over the forepart and heel ends of the sole is, of course, not new in the art and various patterns of distribution are disclosed in the following U.S. Pat. Nos.:

2,557,946
3,444,632
3,808,713
3,824,716
4,044,479
4,141,158
1,607,375
1,979,391
2,155,166

Conventionally, the nubs or ribs as shown in the aforesaid patents are designed for improving traction and, for the most part, are designed for road work as distinguished from boating and the structures shown in these patents fail to meet the requirements for boat use wherein the presence of a film of water so reduces the frictional resistance to sliding that the conventional protrusions, ribs and the like afford very little resistance to slip. A purpose of this invention is to provide a bottom so structured that movement of the bottom parallel to the surface on which it rests will wipe it dry to thus allow a novel friction engendering surface inwardly thereof to become efficiently resistant to slip.

Another purpose is to provide a unique surface structure at the bottom which is self-cleaning in that it will, when flexed, eject grit and small pebbles and thus minimize damage to smooth, fiberglass, gel-coated and painted surfaces.

SUMMARY OF THE INVENTION

As herein illustrated, the shoe bottom has a tread side characterized in that there is means at the edge of the tread side defining a wiper and means on the surface of the tread side bounded by the wiper defining a plurality of uniformly distributed, friction engendering means. The wiper comprises first and second ribs with a space therebetween, the first rib protruding perpendicularly from the bottom at the edge and the second rib protruding perpendicularly from the bottom inwardly of the first rib and being of lesser height than the first rib and spaced therefrom. The said first and second ribs and the groove therebetween constitute means for wiping the surface trod upon substantially free of surface water. The friction engendering means comprise nubs distributed in spaced, parallel rows transversely of the bottom and spaced apart in each row, the nubs and spaces alternating in adjacent rows. The spaces between rows of nubs is greater than the spaces between the nubs in the rows and the nubs are of arcuate section transversely of the sole and of rectangular cross section longitudinally of the sole so that the nubs have greater flexibility longitudinally of the sole than transversely thereof. The crowns of the nubs are substantially flush with the edge of the first rib.

The invention will now be described in greater detail with reference to the accompanying drawings, wherein.

Figure 1:
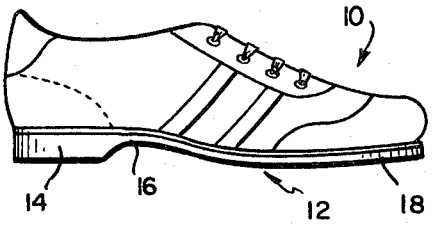
FIG. 1 is a side elevation of a boat shoe provided with a sole according to the invention.
Figure 2:
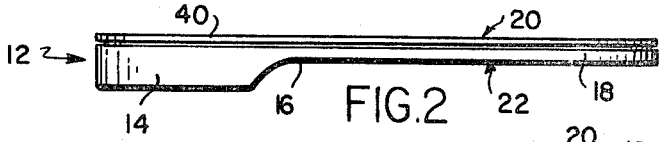
FIG. 2 is an elevation of the sole prior to attachment to the shoe upper.

Referring to the drawings, FIG. 1, there is shown a boat shoe constructed according to this invention comprising an upper 10 of conventional style and a sole 12 made according to this invention attached thereto by conventional methods. The upper is made up of any suitable material and the sole is composed of a flexible material, preferably a rubber-like composition such as natural latex, rubber or synthetic substitutes.

Figure 3:
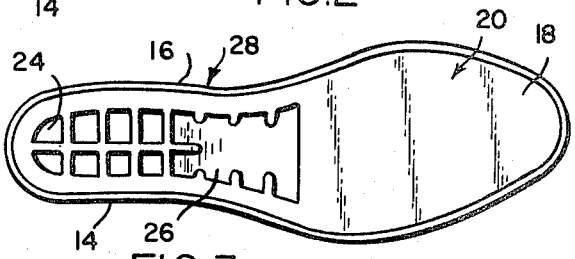
FIG. 3 is a plan view of the attaching side of the sole shown in FIG. 2.

As shown in FIGS. 2 to 7, the sole 12 is made in the form of a preformed blank which can be attached to a lasted upper by means of vulcanization or by means of an adhesive and comprises a heel portion 14, a shank portion 16 and a forepart portion 18. The sole blank has an attaching side 20 and a tread side 22. The attaching side 20 as shown in FIG. 3 at the forepart 18 is substantially smooth and at the heel or rear portion 14 is recessed to reduce the overall weight by deep and shallow cavities 24 and 26. A continuous rib 28 standing perpendicularly from the attaching surface bounds the entire bottom. The structure just described is conventional.

Figure 4:
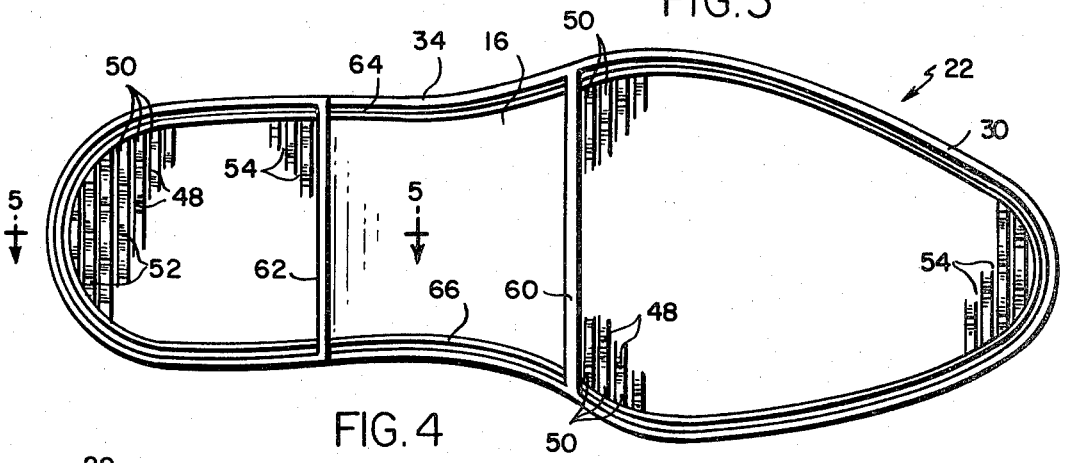
FIG. 4 is a plan view to larger scale of the tread side of the sole shown in FIG. 2.
Figure 5:
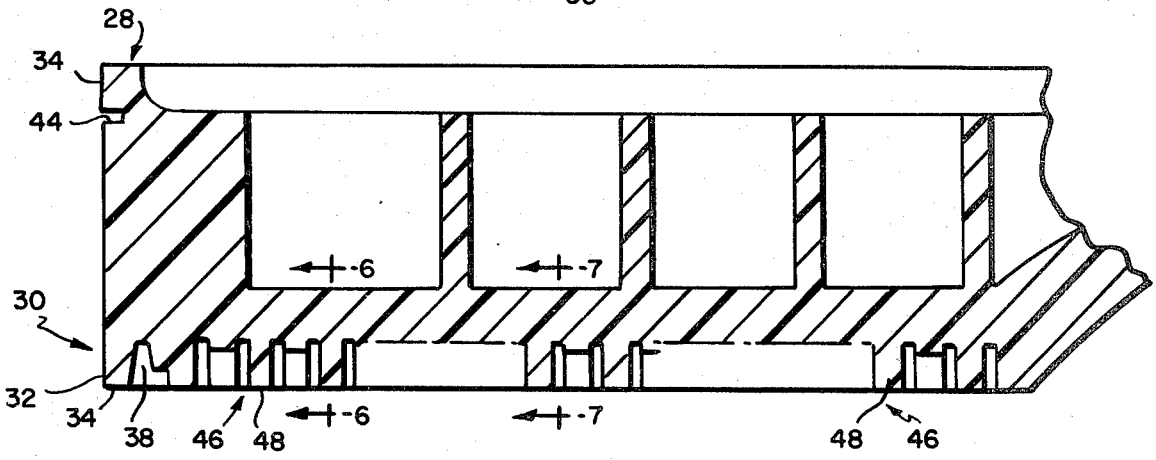
FIG. 5 is a longitudinal section taken on the line 5—5 of FIG. 4.

The tread side 22, as shown in FIG. 4, embodies the structural novelty of this invention and, as illustrated, the bottom of the tread side is bounded by a continuous rib 30 perpendicular to the tread side, the outer surface 32 of which is flush with the outer surface 34 of the rib 28. The rib 30 is of rectangular transverse section and has a flat face 34. Inwardly of the rib 30 and spaced therefrom there is a second rib 36, FIG. 6, which parallels the first rib and defines in conjunction therewith a groove 38. The second rib 36 is also of rectangular transverse section and has a flat face 40. The second rib is of lesser height than the first rib. The first and second ribs 30 and 36 define wiping means at the edge of the bottom which, under pressure, wipe a wet surface relatively dry. As illustrated, there is a groove 44 extending around the edge face of the bottom which permits the bottom to be more effectively attached to the upper.

Figure 6:
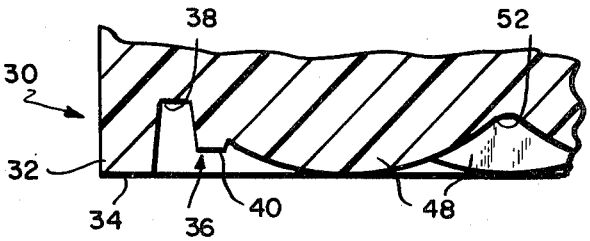
FIG. 6 is a transverse section taken on the line 6—6 of FIG. 5.
Figure 7:
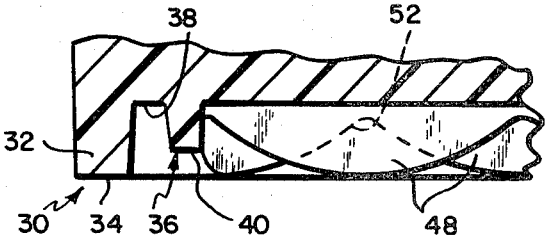
FIG. 7 is a transverse section taken on the line 7—7 of FIG. 5.

Inwardly of the ribs 34 and 36, the tread side is provided at the forepart and heel end with friction engendering means 46 in the form of uniformly distributed nubs 48 distributed in spaced, parallel rows 50 transversely of the bottom. Within each row, the nubs are spaced transversely to provide spaces 52 between nubs and between rows there are spaces 54, the latter being transversely wider than the spaces between nubs in the rows. The nubs 48, FIGS. 6 and 7, are of arcuate section transversely of the sole end of rectangular section longitudinally of the sole and are so arranged in adjacent rows that the nubs in one row alternate with the spaces in adjacent rows. The crowns of the arcuate nubs lie substantially in the plane of the face of the outer rib 30. The nubs are of greater length transversely than their width longitudinally of the sole, hence, they afford a greater resistance to deflection transversely than longitudinally. In other words, the ribs will bend or yield longitudinally of the sole to a greater degree than they will bend or yield transversely of the sole.

As previously stated, the nubs 48 are confined to the forepart and heel end portions of the sole. The shank 16 has a relatively smooth surface and is divided from the forepart and heel end by transverse ribs 60 and 62, the faces of which are flush with the face of the rib 30. Grooves 64 and 66 extend along the opposite sides of the shank portion which are defined by continuations of the rib 30 on the one side and by the surface of the shank on the other side.

As previously described, the first and second ribs and groove defined by the space therebetween function to wipe a wet surface substantially dry so that now the friction engendering nubs bounded by the wiping edges function in their capacity when pressed against the relatively dry surface to effectively resist slipping, thus providing a boat shoe bottom which is particularly effective as distinguished from conventional traction devices on the tread surface of the sole.

The bottom surface as thus described has the further advantage that it is self-cleaning. The alternate spacing of the nubs creates a situation where the nubs, when flexed, will eject any grit or small pebbles from the spaces between the rows of nubs.

As mentioned above, the bottom may be made as a unit and attached to a lasted shoe upper, or it may be molded directly to the bottom of a shoe upper by injection molding.

It should be understood that the present disclosure is for the purpose of illustration only and includes all modifications or improvements which fall within the scope of the appended claims.

What is claimed is:

1. A shoesole having a tread side characterized in that there is means at the edge of the tread side defining a continuous uninterrupted wiper peripherally of the tread side and means on the surface of the tread side bounded by the wiper defining a plurality of uniformly distributioned, longitudinally and transversely-spaced, friction-engendering means which individually are more yieldable to bending in a direction longitudinally of the sole than transversely thereof.

2. A shoesole having a tread side wherein there is means at the edge of the tread side comprising spaced, parallel, continuous, uninterrupted outer and inner ribs, said outer rib protruding perpendicularly from the bottom at the edge and the inner rib protruding perpendicularly from the bottom and being of lesser height and means on the surface of the tread side bounded by the inner rib comprising nubs distributed in spaced, parallel rows transversely of the sole and spaced apart in each row and said nubs being so dimensioned as to be more yieldable to bending in a direction longitudinally of the sole than transversely thereof.

3. A shoesole according to claim 2 wherein the nubs in adjacent rows alternate with the spaces therein.

4. A shoesole according to claim 3 wherein the nubs are arcuate transversely of the sole and wherein the crests of the arcuate nubs are tangent to the plane of the edge of the outer rib.

5. A shoesole according to claim 2 wherein the nubs are of rectangular section longitudinally of the sole.

6. A shoesole according to claim 2 wherein the nubs are arcuate transversely of the sole and rectangular longitudinally of the sole.

7. A shoesole having a tread surface characterized in that there is a continuous, uninterrupted wiper blade on the tread surface circumferentially of the tread surface in the form of a rib projecting perpendicularly from the tread surface and within the area defined by the wiper blade a non-skid surface defined by a plurality of longitudinally and transversely-spaced, uniformly-distributed protrusions which have greater flexibility longitudinally of the sole than transversely of the sole.

8. A shoesole having a side structured to be a tread surface and a side structured to be an attaching surface characterized in that there is means protruding from the tread side defining a flexible wiper blade extending continuously, uninterruptedly along the edge of the sole and means protruding from the tread side within the area of the sole bounded by the blade comprising a plurality of longitudinally and transversely-spaced, uniformly-distributed friction-engendering elements of greater flexibility longitudinally of the sole than transversely of the sole.

9. A shoesole having a tread side bounded by an edge face characterized in that there are means on the tread side defining a continuous, uninterrupted rib circumferentially of the tread side and inwardly thereof a second rib which is of lesser height perpendicular to the tread surface than the first rib, said ribs defining a continuous groove in the tread side adjacent to the edge and means coextensive with the surface areas of the tread side at the forepart and heel end bounded by said ribs in the form of a plurality of longitudinally and transversely-spaced, uniformly-distributed nubs which have greater flexibility longitudinally of the sole than transversely of the sole.

10. A shoesole according to claim 9 wherein the nubs are of arcuate section transversely of the sole.

11. A shoesole according to claim 9 wherein the nubs are of rectangular cross section longitudinally of the sole.

12. A shoesole according to claim 10 wherein the crowns of the arcuate nubs are flush with the edge of the first rib.

13. A shoesole according to claim 9 wherein the nubs are distributed in rows transversely of the tread side and spaced within individual rows and wherein the spaces between rows are greater than the spaces between nubs.

14. A shoesole according to claim 9 wherein the ribs are of rectangular transverse cross section.

15. A shoesole having a tread side bounded by an edge face characterized in that there are means on the tread side defining a first continuous, uninterrupted rib and inwardly thereof a second continuous, uninterrupted rib which is of lesser height perpendicular to the tread side than the first rib and of lesser transverse width than the first rib, said rib defining a continuous groove in the tread side adjacent the edge and a plurality of longitudinally and transversely-spaced nubs coextensive with the surface areas of the tread surface at the forepart and heel ends bounded by said ribs, said nubs being distributed in longitudinally-spaced, parallel, transverse rows with spaces between nubs and with the nubs in alternate rows alternating with the spaces in adjacent rows and wherein the nubs have greater flexibility longitudinally of the tread surface than transversely thereof.

16. A shoesole having a tread side characterized in that it is structured at its edge with continuous, uninterrupted wiping means peripherally of the tread side operable by the lateral movement of the shoesole on the surface upon which it rests to wipe the surface dry and a plurality of transversely and longitudinally-spaced, uniformly-distributed friction-engendering means coextensive with the tread surface inwardly of said wiping means, said friction-engendering means having greater flexibility longitudinally of the sole than transversely thereof.

17. A shoesole having a tread side, continuous, uninterrupted wiping means at the edge of the sole operable in the event of movement of the shoesole in a plane parallel to the surface upon which it rests to wipe the surface dry and a plurality of longitudinally and transversely-spaced, uniformly-distributed friction-engendering means coextensive with the tread surface inwardly of said wiping means, said friction-engendering means having greater flexibility longitudinally of the tread surface than transversely thereof.

18. A shoesole provided with a self-cleaning tread surface comprising transversely-extending, longitudinally-spaced, parallel rows of transversely-spaced nubs of greater flexibility longitudinally of the tread surface than transversely thereof between which there are spaces so that in adjacent rows the nubs in one row are situated opposite the spaces between the nubs in the adjacent row and so that the flexing of the nubs ejects foreign material which may tend to become lodged in the spaces between the rows of nubs.

* * * * *